US007449705B2

(12) United States Patent
Eder

(10) Patent No.: US 7,449,705 B2
(45) Date of Patent: Nov. 11, 2008

(54) LEAD-FREE RADIATION PROTECTION MATERIAL COMPRISING AT LEAST TWO LAYERS WITH DIFFERENT SHIELDING CHARACTERISTICS

(75) Inventor: Heinrich Eder, Munich (DE)

(73) Assignee: Mavig GmbH, Munich (DE)

( * ) Notice: Subject to any disclaimer, the term of this patent is extended or adjusted under 35 U.S.C. 154(b) by 380 days.

(21) Appl. No.: 10/543,538

(22) PCT Filed: Sep. 3, 2004

(86) PCT No.: PCT/EP2004/009859

§ 371 (c)(1),
(2), (4) Date: Jul. 27, 2005

(87) PCT Pub. No.: WO2005/024846

PCT Pub. Date: Mar. 17, 2005

(65) Prior Publication Data

US 2006/0151750 A1 Jul. 13, 2006

(30) Foreign Application Priority Data

Sep. 3, 2003 (DE) ..... 103 40 639
Jan. 8, 2004 (DE) ..... 10 2004 001 328

(51) Int. Cl.
*G21F 3/02* (2006.01)

(52) U.S. Cl. ..... 250/516.1; 250/515.1; 250/505.1; 250/519.1

(58) Field of Classification Search .... 250/505.1–519.1
See application file for complete search history.

(56) References Cited

U.S. PATENT DOCUMENTS

| | | | | |
|---|---|---|---|---|
| 3,514,607 | A | 5/1970 | Webster | |
| 4,795,654 | A * | 1/1989 | Teleki | 428/635 |
| 5,247,182 | A * | 9/1993 | Servant et al. | 250/516.1 |
| 5,321,272 | A | 6/1994 | Granfors et al. | |
| 6,674,087 | B2 * | 1/2004 | Cadwalader et al. | 250/515.1 |
| 2002/0148980 | A1 * | 10/2002 | Cadwalader et al. | 250/515.1 |
| 2004/0041107 | A1 * | 3/2004 | Cadwalader et al. | 250/519.1 |
| 2004/0262546 | A1 * | 12/2004 | Thiess et al | 250/515.1 |

FOREIGN PATENT DOCUMENTS

| | | |
|---|---|---|
| DE | 199 55 192 A1 | 5/2001 |
| DE | 201 00 267 U1 | 8/2001 |
| DE | 102 34 159 C1 | 11/2003 |
| EP | 0 371 699 | 6/1990 |
| WO | WO 90/06581 | 6/1990 |

* cited by examiner

*Primary Examiner*—Jack I. Berman
*Assistant Examiner*—Andrew Smyth
(74) *Attorney, Agent, or Firm*—Scully, Scott, Murphy & Presser, P.C.

(57) ABSTRACT

The present invention relates to a lead-free radiation protection material in the energy range of an X-ray tube having a voltage of from 60 to 125 kV. The lead-free radiation protection material has a layer structure having at least two layers with different shielding properties.

31 Claims, 1 Drawing Sheet

LEAD-FREE RADIATION PROTECTION MATERIAL COMPRISING AT LEAST TWO LAYERS WITH DIFFERENT SHIELDING CHARACTERISTICS

The invention relates to a lead-free radiation protection material in the energy range of an X-ray tube having a voltage of from 60 to 125 kV.

Conventional radiation protection clothing in X-ray diagnostics mostly contains lead or lead oxide as the protective material.

Because of its toxicity, lead and the processing thereof result in considerable damage to the environment. Because of lead's very great weight, protective clothing of lead is unusually heavy, which means a considerable physical strain on the user. When wearing protective clothing, for example during medical operations, the weight is of great importance in terms of wear comfort and the physical strain on the medical staff.

Lead substitute materials for use in radiation protection are already known.

DE 199 55 192 A1 describes a process for the production of a radiation protection material from a polymer as matrix material and the powder of a metal having a high atomic number.

DE 201 00 267 U1 describes a highly resilient, lightweight, flexible, rubber-like radiation protection material, wherein chemical elements and oxides thereof having an atomic number greater than or equal to 50 are added to a specific polymer.

In order to reduce the weight as compared with conventional lead aprons, EP 0 371 699 A1 proposes a material that likewise contains, in addition to a polymer as the matrix, elements having a higher atomic number. A large number of metals is mentioned therein.

DE 102 34 159 A1 describes a lead substitute material for radiation protection purposes in the energy range of an X-ray tube having a voltage of from 60 to 125 kV.

Depending on the elements used, the degree of attenuation or the lead equivalent (International Standard IEC 61331-1, Protective devices against diagnostic medical X-radiation) of the material in question in some cases exhibits a pronounced dependency on the radiation energy, which is a function of the voltage of the X-ray tube.

Compared with lead, the absorption behaviour of lead-free materials in some cases differs considerably depending on the X-ray energy. For this reason, an advantageous combination of different elements is required in order to imitate the absorption behaviour of lead while at the same time maximising the saving in terms of weight.

For this reason, the field of application of commercial lead-free radiation protection clothing is generally limited.

In order to be able to replace lead for radiation protection purposes, an absorption behaviour is required, in relation to lead, that is as uniform as possible over a relatively large energy range, because radiation protection materials are conventionally classified according to the lead equivalent, and radiation protection calculations are frequently based on lead equivalents.

In the case of a lead substitute material composed of protective layers, the overall lead equivalent is understood as being the lead equivalent of the sum of all the protective layers. The overall nominal lead equivalent is understood as being the lead equivalent to be indicated by the manufacturer according to DIN EN 61331-3 for personal protective equipment.

During measurements of the lead equivalents and the attenuation factors in dependence on the tube voltage it has been found that the protective effect of lead-free materials in particular at an X-ray tube voltage of from 60 to 80 kV is considerably lower compared with lead than in the energy range of from 80 to 100 kV.

There are substantially two reasons for this. On the one hand, the mass attenuation coefficient of lead-free materials such as tin, at the middle energy of the 60 kV spectrum, i.e. at about 25 keV, is lower than that of lead. On the other hand, there is a particularly great dose build-up effect in this low energy range. In other words, the protective effect of the material is reduced by the formation of secondary radiation on the radiation outlet side.

In order to achieve a high protective effect, the dose build-up in the lead-free material should remain as low as possible. As already mentioned, a secondary radiation is excited in the material, which in large radiation fields acts to diminish the shielding effect of the material. In most cases, the excited fluorescent radiation is responsible for the dose build-up.

The dose build-up is expressed numerically by the so-called build-up factor according to IEC 61331-1.

The object of the present invention is to provide a lead-free radiation protection material that exhibits low or only negligible amounts of secondary radiation over the energy range of an X-ray tube having a voltage of from 60 to 125 kV and that accordingly ensures an optimum shielding effect.

The object of the present invention is achieved by a lead-free radiation protection material according to patent claim 1.

The present invention relates to a lead-free radiation protection material in the energy range of an X-ray tube having a voltage of from 60 to 125 kV, having a layer structure of at least two layers with different shielding properties.

The invention relates further to radiation protection clothing made from the lead-free radiation protection material according to the invention.

It is important according to the invention that the lead-free radiation protection material has at least two layers with different shielding properties. In this two-layer structure, the composition of the protective materials in one layer is such that one layer alone does not achieve the desired properties in respect of the shielding effect, in particular over a larger energy range of from 60 to 125 kV. Only the two layers together give optimum shielding properties.

The layer structure, comprising at least two layers with different shielding properties, of the lead-free radiation protection material according to the invention is preferably composed of a secondary radiation layer and a barrier layer.

The secondary radiation layer converts a large part of the incident X-rays into secondary radiation, i.e. fluorescent radiation.

The barrier layer blocks the fluorescent radiation produced in the secondary radiation layer and itself develops only slight secondary radiation.

The secondary radiation layer and the barrier layer, as a layer structure, exhibit very good shielding properties when the lead-free radiation protection material according to the invention is processed to form protective clothing. The secondary radiation layer is then provided as the layer of the protective clothing that is remote from the body. The barrier layer, which is arranged in the protective clothing as the layer that is close to the body, effectively blocks the fluorescent radiation produced in the secondary radiation layer in the direction of the body. This ensures optimum shielding efficiency against X-radiation.

The figures serve to explain the invention further.

Figure 1:
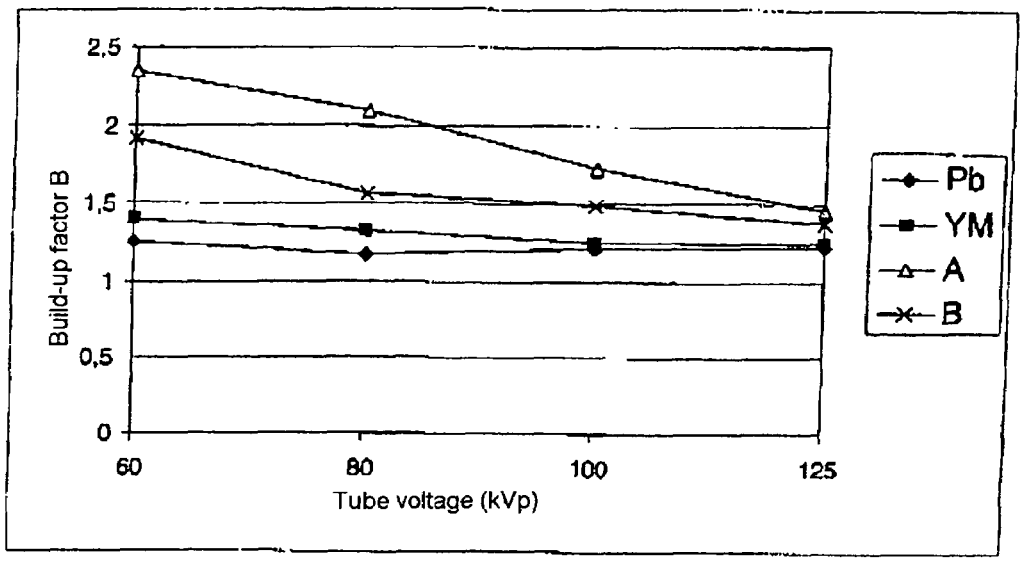
FIG. 1 shows build-up factors of various materials.

The lead-free radiation protection material is suitable in particular for the energy range of an X-ray tube having a voltage of from 60 to 125 kV, preferably from 60 to 100 kV, especially from 60 to 80 kV.

The secondary radiation layer comprises at least one element of atomic numbers 39 to 60 or a compound thereof. Examples of a suitable element are tin, iodine, caesium, barium, lanthanum, cerium, praseodymium, neodymium and compounds thereof. Particular preference is given to tin or a mixture of tin and caesium.

The secondary radiation layer can comprise, for example, tin in an amount of from 50 to 100 wt. %. In a preferred embodiment of the invention, the secondary radiation layer comprises tin in an amount of from 50 to 90 wt. % and at least one further element and/or compound(s) thereof of atomic numbers 39 to 60, in an amount of from 10 to 50 wt. %.

The barrier layer of the lead-free radiation protection material according to the invention comprises at least one element of atomic numbers greater than 71 (with the exception of lead) or a compound thereof. In a preferred embodiment, the element is selected from bismuth, tungsten and compounds thereof. The use of bismuth is preferred. It has proved advantageous for the barrier layer to comprise tungsten in an amount of from 0 to 30 wt. % and/or bismuth in an amount of at least 30 wt. %.

It has been shown that the barrier layer exhibits an even better barrier effect against secondary radiation of the secondary radiation layer when it further comprises at least one element of atomic numbers 61 to 71 or compounds thereof. In a preferred embodiment of the present invention, the element is selected from the group erbium, holmium, dysprosium, terbium, gadolinium, europium, samarium, lutetium, ytterbium, thulium and compounds thereof. Particular preference is given to gadolinium or a compound thereof.

It has further proved advantageous for the barrier layer additionally to comprise at least one element from the group tantalum, hafnium, thorium, uranium and compounds thereof.

The proportion by weight of the further elements and/or their compounds present in the barrier layer may be up to 80 wt. %. The amount of the further element(s) and/or compounds thereof is preferably in a range of from 20 to 70 wt. %.

The at least two layers of the lead-free material according to the invention comprise a matrix material in an amount of from 0 to 12 wt. %, preferably from 2 to 10 wt. %, especially from 4 to 8 wt. %.

The matrix material forms almost a carrier layer for the protective materials, in which the latter are dispersed in powder form; Examples of a matrix material are rubber, latex, synthetic flexible or rigid polymers and silicone materials.

It has accordingly been found, surprisingly, that the dose build-up, or the secondary radiation yield, in the lead-free radiation protection material according to the invention is considerably lower than in commercial lead-free materials as a result of its separation into a layer having low secondary radiation and a layer having high secondary radiation. Reference is made in this connection to FIG. 1. In FIG. 1, YM denotes the curve of the lead-free material according to the invention, and the curves A and B are based on commercial lead-free materials, which represent a powder mixture without a layer structure. It will readily be seen that the YM curve comes very close to the Pb curve, which means that the lead-free radiation protection material according to the invention has similarly good shielding properties to the lead material.

The secondary radiation layer and/or the barrier layer of the lead-free radiation protection material according to the invention may preferably comprise at least one pure-material layer. The expression "pure-material layer" means a layer that comprises, in addition to matrix material, in each case only one of the above-mentioned elements and compounds thereof, i.e. one protective substance. In a preferred embodiment, these pure-material layers comprise less than 5 wt. % matrix material.

It has further been found, surprisingly, that a protective substance or a combination of protective substances provided in separate pure-material layers possesses a substantially better protective effect, i.e. shielding effect, than a material in which all the materials are mixed, for example in the form of a powder.

It has been found in practice that the pure-material layers provide a particularly good shielding effect when they are greatly compressed, i.e. when gaps that are as small as possible are present between the particles of the shielding material, so that a layer having as high a density as possible is present. Compression of the layer is effected, for example, by way of a suitable particle size distribution and/or by mechanical compression by known processes.

In a preferred embodiment, the pure-material layers should be compressed to more than 75 vol. %. Compression of the pure-material layers to more than 90 vol. % is particularly preferred.

In a preferred embodiment of the lead-free radiation protection material according to the invention, the secondary radiation layer and/or the barrier layer comprise(s) at least one pure-material layer. The secondary radiation layer is in such a form that it comprises elements of atomic numbers 39 to 60 or their compounds. It is also possible to provide a plurality of pure-material layers comprising these elements and/or their compounds.

In a further preferred embodiment of the lead-free radiation protection material according to the invention, the barrier layer comprises one or more pure-material layers of elements of atomic numbers greater than 71 and/or compounds thereof. The barrier layer may additionally also comprise one or more pure-material layers of elements of atomic numbers 61 to 71 or compounds thereof.

The elements having atomic numbers from 61 to 71 and/or their compounds may also be present in a separate layer in the form of a so-called intermediate layer arranged between the secondary radiation layer and the barrier layer.

In some cases practice has shown that the best shielding results are obtained when the highly compressed pure-material layers are present in the form of metal foils, such as, for example, in the form of foil strips or foil plates.

The metal foils generally have a thickness of from 0.005 to 0.25 mm.

The foils are normally located one above the other without being joined together. However, if a bond is to be produced between the foils for practical or technical reasons, such bonds can be produced according to conventional processes.

It is shown in the following that the lead-free radiation protection material according to the invention, in comparison with already known lead-free radiation protection materials, exhibits very good results in respect of the shielding effect, especially at 60 kV.

The following materials were produced from the following constituents and were tested:

Constituents: 40 wt. % tin, 10 wt. % cerium oxide, 20 wt. % gadolinium oxide, 20 wt. % bismuth, 10 wt. % tungsten.

The radiation protection materials were processed as follows:

Material 1: The above constituents are uniformly mixed in powder form in a polymer matrix;

Material 2: Layering of the individual constituents in pure-material layers, in powder form;

Material 3: Layering of the above constituents individually in pure-material foils.

The weight per unit area was 4.7 kg/m$^2$ in all cases.

In the narrow beam cluster of an X-ray tube, the following attenuation factors were obtained according to Table 1 below:

TABLE 1

| Tube voltage (kV) | Material 1 | Material 2 | Material 3 |
|---|---|---|---|
| 60 | 348 | 497 | 746 |
| 125 | 9.85 | 11.27 | 11.89 |

As will be seen from the values of the attenuation factors, the lead-free radiation protection material according to the invention arranged in layers (material 2 and material 3) exhibits a better shielding effect than the powder mixture of material 1. In particular, a very good shielding effect is found at 60 kV.

It is important that the pure-material layers in the radiation protection material are layered in such a manner that the layers are arranged with increasing secondary radiation. Accordingly, when the material is processed to form radiation protection clothing, the layer having the highest secondary radiation yield is remote from the body, while the layer having the lowest secondary radiation is arranged close to the body.

In a further preferred embodiment, the at least one pure-material layer of the secondary radiation layer and of the barrier layer of the lead-free radiation protection material according to the invention may be present in a so-called sandwich structure. A sandwich structure is understood as being a structure in which further layers are provided between the pure-material layers. In a particular embodiment, the at least one pure-material layer has a carrier layer on one side in each case. Alternatively, the at least one pure-material layer may have a carrier layer on both sides. The carrier layers are preferably formed by a polymer. The polymer may be one that is also used as the matrix material. The polymer is usually a latex or elastomer polymer.

It has proved advantageous in practice for the one or more carrier layer(s) in the layer structure of the lead-free radiation protection material according to the invention to have a thickness of from 0.01 to 0.4 mm.

If necessary, the carrier layer or layers may also comprise small amounts of protective substances, as described above. However, they are generally free of protective substances.

The carrier layers on one side or on both sides of the pure-material layers contribute towards increasing the mechanical stability of the "internal", highly compressed material layer, whether it be the secondary radiation layer or the barrier layer, while the radiation-shielding effect of the individual protective layers is improved.

Figure 2:
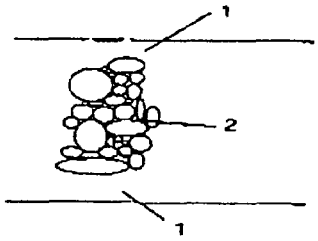
FIG. 2 shows a sandwich structure of the lead-free radiation protection material according to the invention.

FIG. 2 shows a sandwich structure of the lead-free radiation protection material according to the invention. The highly compressed layer of protective substance 2 is surrounded on both sides by a carrier layer 1, which increases the mechanical stability of the structure.

It is also possible to form an alternative sandwich structure by providing a layer having low secondary radiation on both sides of each layer having high secondary radiation. In this manner, the barrier layer effect of the barrier layers having low secondary radiation can contribute towards the provision of a direct barrier effect, i.e. on both sides, for layers having high secondary radiation.

In general, the radiation protection materials in the individual layers are in the form of metal powders having particle sizes of from 2 to 75 μm. It is important that there should be as little matrix material as possible in the gaps.

It has been found that, in a layer system having an even number of layers, the mass loading (weight per unit area) is 1:1. For example, for a nominal lead equivalent of 0.5 mm (Pb), a weight per unit area of 2.6 kg/m$^2$ per layer is obtained in the case of two layers, which may each in turn be divided into two layers.

In a layer structure having an odd number, it has proved advantageous to divide the weights per unit area 2:1 (secondary radiation layer:barrier layer).

In a preferred embodiment of the present invention, the division of the weights per unit area in the case of a layer structure of three layers is 1:1:1. This division is particularly advantageous in the case of a layer structure comprising secondary radiation layer:intermediate layer:barrier layer. The intermediate layer comprises predominantly at least one element of atomic numbers 61 to 71 or their compounds.

The lead-free radiation protection material according to the invention is suitable for the production of radiation protective clothing such as, for example, a radiation protection apron.

In addition, the material according to the invention can advantageously be used, for example, in protective gloves, patient coverings, gonad protection, ovary protection, protective dental shields, fixed lower-body protection, table attachments, fixed or movable radiation protection walls or radiation protection curtains.

The invention is explained in greater detail hereinbelow by means of examples.

EXAMPLE 1

A lead-free radiation protection material according to the invention is produced having a layer (A), which corresponds to the secondary radiation layer, and a layer (B), which corresponds to the barrier layer. Layer (A) comprises 54 wt. % tin, 36 wt. % cerium and 10 wt. % matrix material. Layer (B) comprises 36 wt. % gadolinium, 36 wt. % bismuth, 18 wt. % tungsten and 10% matrix.

EXAMPLE 2

A lead-free radiation protection material according to the invention is produced. Layer (A) comprises 90 wt. % tin and 10 wt. % matrix, while layer (B) comprises 54 wt. % gadolinium, 36 wt. % bismuth and 10 wt. % matrix material.

EXAMPLE 3

A radiation protection material according to the invention comprising a layer (A) as in Example 1 and a layer (B) as in Example 2 is produced.

EXAMPLE 4

A radiation protection material according to the invention having a layer (A) as in Example 2 and a layer (B) as in Example 1 is produced.

The measurement results for the lead equivalents (LE) of the radiation protection materials produced in Examples 1 to 4 for tube voltages of 60, 80, 100 and 120 kV are shown in Table 2 hereinbelow. The weight per unit area of the protective substances is 4.7 kg/m$^2$ in each case.

TABLE 2

| Tube voltage (kV) | Example 1 mm LE | Example 2 mm LE | Example 3 mm LE | Example 4 mm LE |
|---|---|---|---|---|
| 60 | 0.51 | 0.57 | 0.58 | 0.55 |
| 80 | 0.62 | 0.68 | 0.71 | 0.66 |
| 100 | 0.60 | 0.65 | 0.66 | 0.63 |
| 125 | 0.49 | 0.51 | 0.53 | 0.50 |

The invention claimed is:

1. Lead-free radiation protection material in the energy range of an X-ray tube having a voltage of from 60 to 125 kV, having a layer structure of at least two layers with different shielding properties, said at least two layers comprising a secondary radiation layer and a barrier layer, wherein the secondary radiation layer comprises tin in an amount of from 50 to 90 wt. % and at least one further element and/or compound(s) thereof of atomic numbers 39 to 60 in an amount of from 10 to 50 wt. %.

2. Lead-free radiation protection material according to claim 1, wherein the element is selected from tin, iodine, caesium, barium, lanthanum, cerium, praseodymium, neodymium and compounds thereof.

3. Lead-free radiation protection material according to claim 1, wherein the secondary radiation layer comprises tin and cerium or a compound thereof.

4. Lead-free radiation protection material in the energy range of an X-ray tube having a voltage of from 60 to 125 kV, having a layer structure of at least two layers with different shielding properties, said at least two layers comprising a secondary radiation layer and a barrier layer, wherein the barrier layer comprises at least one element of atomic numbers greater than 71 or a compound thereof and wherein said at least one element is selected from bismuth, tungsten and compounds thereof and wherein the barrier layer further comprises at least one element of atomic numbers 61 to 71 or compounds thereof.

5. Lead-free radiation protection material according to claim 4, wherein the element is selected from the group erbium, holmium, dysprosium, terbium, gadolinium, europium, samarium, lutetium, ytterbium and thulium and compounds thereof.

6. Lead-free radiation protection material according to claim 5, wherein the element is gadolinium.

7. Lead-free radiation protection material according to claim 4, wherein at least one element of atomic numbers 61 to 71 or compounds thereof is present in the form of an intermediate layer which is arranged between the secondary radiation layer and the barrier layer.

8. Lead-free radiation protection material according to claim 4, wherein the barrier layer further comprises elements of atomic numbers greater than 71 and/or their compounds in an amount of up to 80 wt. %.

9. Lead-free radiation protection material according to claim 8, wherein the amount is in a range of from 20 to 70 wt. %.

10. Lead-free radiation protection material in the energy range of an X-ray tube having a voltage of from 60 to 125 kV, having a layer structure of at least two layers with different shielding properties, said at least two layers comprising a secondary radiation layer and a barrier layer, wherein the barrier layer comprises tungsten or compounds thereof in an amount of from 0 to 30 wt. % and/or bismuth or compounds thereof in an amount of at least 30 wt. %.

11. Lead-free radiation protection material according to claim 7, wherein the secondary radiation layer and/or the intermediate layer and/or the barrier layer comprise(s) at least one pure-material layer.

12. Lead-free radiation protection material according to claim 11, wherein the pure-material layers are greatly compressed.

13. Lead-free radiation protection material according to claim 12, wherein the pure-material layers are compressed to more than 75 vol. %.

14. Lead-free radiation protection material according to claim 13, wherein the pure-material layers are compressed to more than 90 vol. %.

15. Lead-free radiation protection material according to claim 14, wherein the greatly compressed pure-material layers are in the form of metal foils.

16. Lead-free radiation protection material according to claim 15, wherein the metal foils have a thickness of from 0.005 to 0.25 mm.

17. Lead-free radiation protection material according to claim 16, wherein the metal foils are foil strips or foil plates.

18. Lead-free radiation protection material according to claim 11, wherein the at least one pure-material layer has a carrier layer on one side.

19. Lead-free radiation protection material according to claim 11, wherein the at least one pure-material layer has a carrier layer on both sides.

20. Lead-free radiation protection material according to claim 18, wherein the carrier layers are formed by a polymer.

21. Lead-free radiation protection material according to claim 20, wherein the polymer is a latex or elastomer polymer.

22. Lead-free radiation protection material according to claim 20, wherein the carrier layers have a thickness of from 0.01 to 0.4 mm.

23. Lead-free radiation protection material according to claim 18, wherein the carrier layers comprise small amounts of protective substances.

24. Lead-free radiation protection material according to claim 11, wherein the pure-material layers of the protective foil are so composed that the layers are arranged according to increasing secondary radiation.

25. Lead-free radiation protection material according to claim 11, wherein each layer having high secondary radiation has on both sides a layer having low secondary radiation.

26. Radiation protection clothing of a lead-free radiation protection material according to claim 1.

27. Radiation protection clothing according to claim 26 in the form of an apron.

28. Radiation protection clothing of a lead-free radiation protection material according to claim 4.

29. Radiation protection clothing according to claim 28 in the form of an apron.

30. Radiation protection clothing of a lead-free radiation protection material according to claim 10.

31. Radiation protection clothing according to claim 30 in the form of an apron.

* * * * *